US007885592B2

(12) United States Patent
Schmitz et al.

(10) Patent No.: US 7,885,592 B2
(45) Date of Patent: Feb. 8, 2011

(54) ROTARY OPERATED MECHANISM FOR RETRACTING PAPER PATHWAYS OF PRINTERS

(75) Inventors: Gregory P. Schmitz, Los Gatos, CA (US); David G. Duff, Portola, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 602 days.

(21) Appl. No.: 11/824,318

(22) Filed: Jun. 29, 2007

(65) Prior Publication Data

US 2009/0003878 A1 Jan. 1, 2009

(51) Int. Cl.
*G03G 15/20* (2006.01)
*B65H 5/00* (2006.01)

(52) U.S. Cl. ..... 399/329; 271/225

(58) Field of Classification Search ..... 399/124; 271/225
See application file for complete search history.

(56) References Cited

U.S. PATENT DOCUMENTS 7,185,888 B2 3/2007 Duff et al.
2007/0029721 A1 2/2007 Duff et al.

*Primary Examiner*—David M Gray
*Assistant Examiner*—Erika Villaluna
(74) *Attorney, Agent, or Firm*—Fay Sharpe LLP

(57) ABSTRACT

An apparatus is provided for clearing paper jams in a module along a print path of a printer, the module having nip baffles and a rotatable and removable core element defining a print path therethrough. The apparatus comprises at least one cam, a rotatable handle mechanism and a ramp drive mechanism to facilitate the paper jam clearing and removal of the core element from the module.

19 Claims, 12 Drawing Sheets

ROTARY OPERATED MECHANISM FOR RETRACTING PAPER PATHWAYS OF PRINTERS

CROSS REFERENCE TO RELATED PATENTS AND APPLICATIONS

This application is related to U.S. Pat. No. 7,185,888, issued on Mar. 6, 2007 and entitled Rotational Jam Clearance Apparatus, which is incorporated herein by reference. This application is also related to U.S. application Ser. No. 11/582, 011, entitled Rotational Jam Clearance Apparatus, naming Duff et al. as inventors, and filed Oct. 17, 2006 as a divisional of U.S. Pat. No. 7,185,888, which application is incorporated herein by reference.

BACKGROUND

In some known modular printing systems, modules are used to build a print path through the system. The modules typically include a core element, or director core. In some forms, a central axis of the director core is used as a mechanism for clearing paper jams. The paper jam clearing procedure is performed by simply rotating the director core. As the director core is rotated, the paper is wound up around the outside of the core. This is an advantageous and desirable feature for this type of device.

However, bidirectional transport of documents between modules of the printing system typically requires merging at the boundaries of the modules. Interference is cleared from these boundaries and any sheet crossing such boundaries must be spindled, as noted above, as the core element is rotated.

Before this procedure can be performed, the central core must be decoupled from the paper path by retracting several sets of nip baffles. This is presently accomplished by individually retracting the several sets of nip baffles.

In this regard, FIGS. 1(*a*) through 1(*c*) demonstrate a typical paper jam clearing cycle for one of the afore-noted devices. With reference to FIG. 1(*a*), the paper path 342 having a transport direction 390 is defined within the system 300 and has resident therein document page or media 370. Also shown are a director core 310, nip baffle pairs 330, 332 and 334, pinch rollers 320 and 324, articulating tips 350 and 352 and baffles 360 and 362. For reference, a frame 305 is also illustrated. As shown in FIGS. 1(*b*) and 1(*c*), with just the simple rotation of the director core (410 and 710) in process directions 490 and 790, paper (shown at 470 and 770, respectively) is spooled around the core during a 360 degree rotation cycle. Notice the dashed line acting as the sheet of paper has been spooled around the director core. In FIG. 1(*b*), nip baffle pairs 430, 432, 434, 436, 438 and 439, baffles 460 and 462, media path 442 and frame 405 are shown. The nip baffle pairs are in an open state. With reference to FIG. 1(*c*), the three sets of nip baffles 730, 732, 734, 736, 738 and 739 are also shown in the open state (retracted). As noted above, there is typically no means provided for automatically opening the nip baffles. This is accomplished manually for each set of nip baffles. In FIG. 1(*c*), baffles 760, 762 and 764, frame 705, media path 744, roller 720 and pivotal support 780 are also shown.

INCORPORATION BY REFERENCE

This application is related to U.S. Pat. No. 7,185,888, issued on Mar. 6, 2007 and entitled Rotational Jam Clearance Apparatus, which is incorporated herein by reference. This application is also related to U.S. application Ser. No. 11/582, 011, entitled Rotational Jam Clearance Apparatus, naming Duff et al. as inventors, and filed Oct. 17, 2006 as a divisional of U.S. Pat. No. 7,185,888, which application is incorporated herein by reference.

BRIEF DESCRIPTION

The presently described embodiments relate to an apparatus for clearing paper jams in a module along a print path of a printer, the module having nip baffles and a rotatable and removable core element defining a print path therethrough.

In one aspect of the presently described embodiments, the apparatus comprises at least one cam connected to the core element operative to engage pins extending from the nip baffles, a rotatable handle connected to the core element to facilitate insertion of the core element into the module and retraction of the core element from the module, the handle being operative to rotate the cam to change an orientation of engaged nip baffles through movement of the pins and a ramp drive mechanism associated with the handle operative to shift the cam toward the pins during insertion and away from the pins during retraction.

In another aspect of the presently described embodiments, the at least one cam comprises radial extensions having grooves therein sized to receive the pins.

In another aspect of the presently described embodiments, the at least one cam comprises two cams.

In another aspect of the presently described embodiments, the at least one cam is one cam.

In another aspect of the presently described embodiments, the apparatus further comprises a second set of pins associated with a second set of nip baffles operatively connected to the nip baffles through a gear mechanism.

In another aspect of the presently described embodiments, the ramp drive mechanism comprises a configuration of detents and ramps.

In another aspect of the presently described embodiments, the apparatus comprises a first cam connected to the core element operative to engage a first set of pins extending from a first set of the nip baffles, a second cam connected to the core element operative to engage a second set of pins extending from a second set of the nip baffles, a rotatable handle connected to the core element to facilitate insertion of the core element into the module and retraction of the core element from the module, the handle being operative to rotate the first and second cams to change an orientation of engaged nip baffles of the first set of nip baffles and of the second set of nip baffles through respective movement of the first set pins and the second set of pins and a ramp drive mechanism associated with the handle operative to shift the first cam and the second cam toward the first and second set of pins during insertion and away from the first and second set of pins during retraction.

In another aspect of the presently described embodiments, the first and second cam each comprises radial extensions having grooves therein sized to receive pins.

In another aspect of the presently described embodiments, the ramp drive mechanism comprises a configuration of detents and ramps.

In another aspect of the presently described embodiments, the apparatus comprises at least one cam connected to the core element operative to engage a set of pins extending from a first set of the nip baffles, a set of gears operatively connecting the first set of the nip baffles with a second set of the nip baffles, a rotatable handle connected to the core element to facilitate insertion of the core element into the module and retraction of the core element from the module, the handle being operative to rotate the cam to change an orientation of engaged nip baffles through movement of the set of pins and a ramp drive mechanism associated with the handle operative to shift the cam toward the pins during insertion and away from the pins during retraction.

In another aspect of the presently described embodiments, the at least one cam comprises radial extensions having grooves therein sized to receive the pins.

In another aspect of the presently described embodiments, the ramp drive mechanism comprises a configuration of detents and ramps.

In another aspect of the presently described embodiments, a method comprises engaging pins extending from the nip baffles by a cam, rotating the cam to change an orientation of engaged nip baffles through movement of the pins and shifting the cam toward the pins during insertion and away from the pins during retraction.

DETAILED DESCRIPTION

The presently described embodiments relate to a mechanism which can retract the nip baffles situated around the central core element of a module used in a modular printing system. The contemplated system for rotating the core element for either clearing a paper jam or performing other types of maintenance and also for retracting multiple sets of nip baffles has the following features and/or advantages:

1) The subject mechanism is able to function in the presence or absence of power to the system.

2) Only one user input is necessary to retract the nip baffles and remove the director core. This input is the simple rotation of a handle or knob attached to the director assembly.

3) The retraction mechanism has a fail safe mode between the nip baffles and director assembly. The nip baffles are sprung in the normally open position to avoid collision with the core element during the jam clearing cycle or other maintenance.

4) The mechanism lends itself to automation or machine assistance.

Figure 1A:
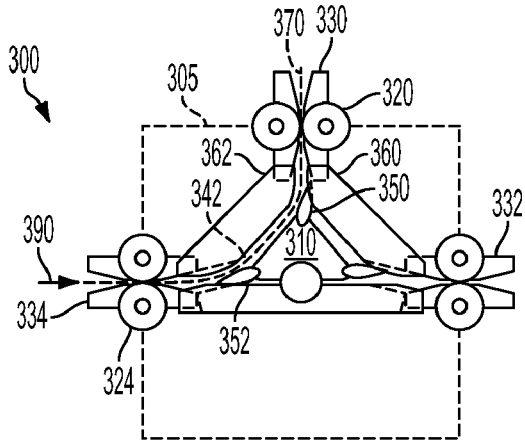
FIG. 1A PRIOR ART
FIGS. 1(*a*)-(*c*) are side views of a conventional print module.
Figure 1B:
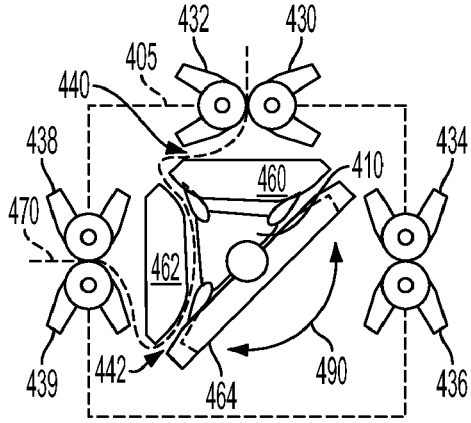
FIG. 1B PRIOR ART
Figure 1C:
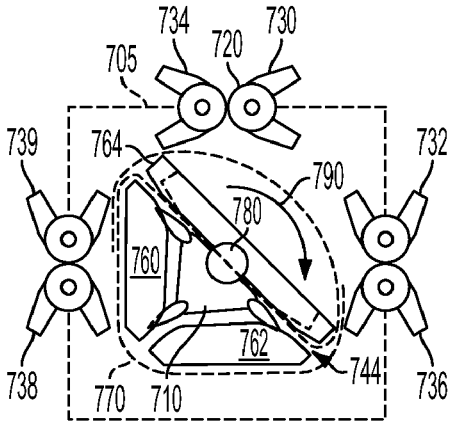
FIG. 1C PRIOR ART
Figure 2:
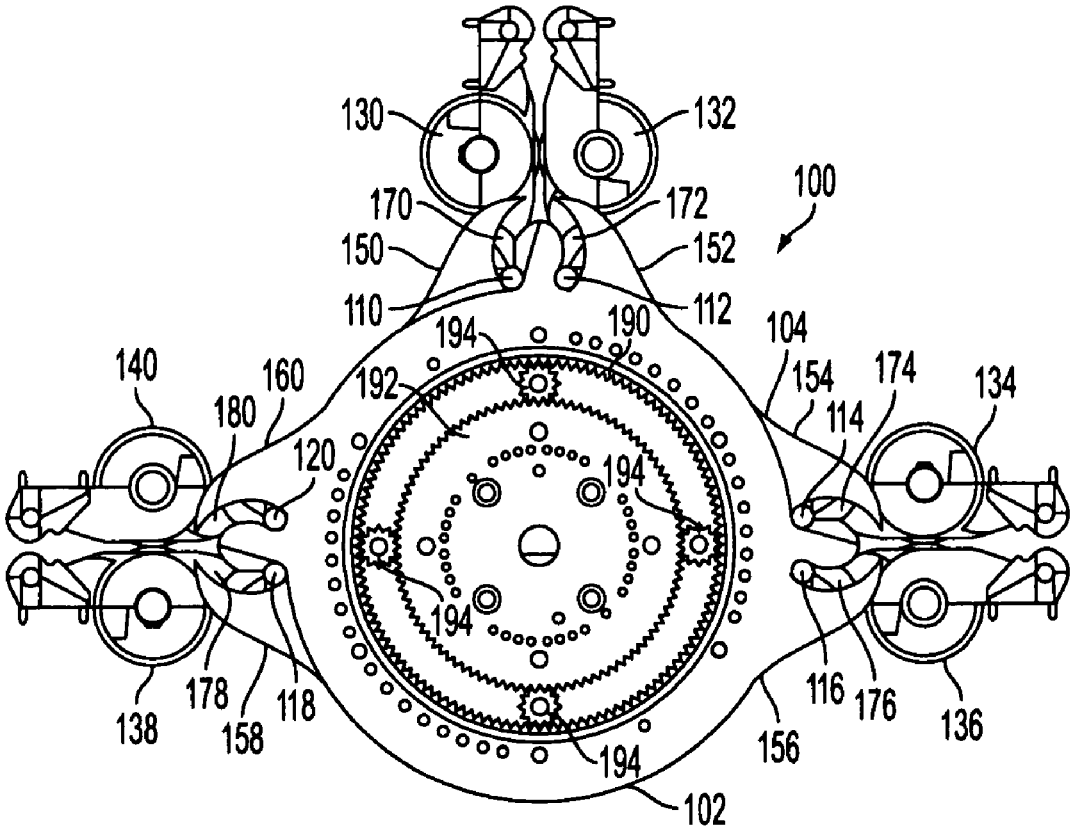
FIG. 2 is a side view of a dual cam arrangement of the presently described embodiments.
Figure 3:
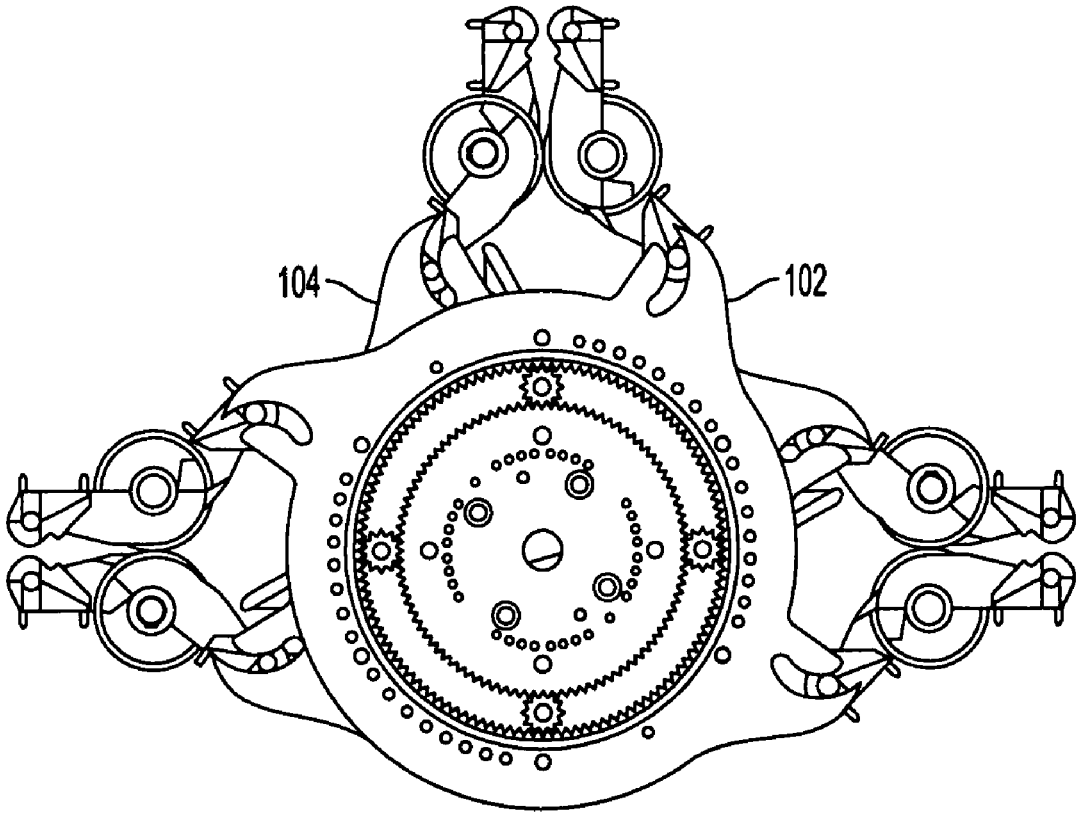
FIG. 3 is a side view of a dual cam arrangement of the presently described embodiments.
Figure 4:
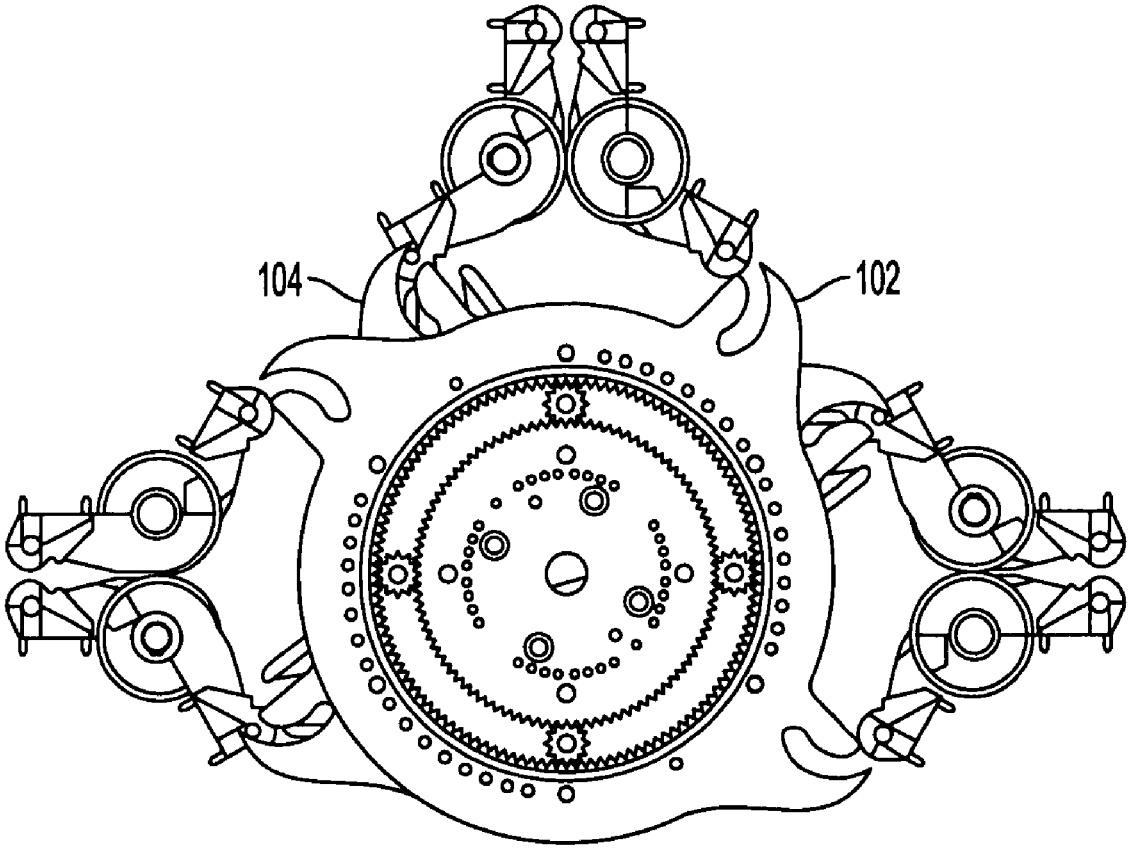
FIG. 4 is a side view of a dual cam arrangement of the presently described embodiments.

With reference now to FIGS. 2-4, an embodiment using a dual cam retractor mechanism is shown. As shown in FIG. 2, the mechanism 100 includes a first cam 102 connected to the core element (not shown). A second cam 104 that is connected to the core element is also shown. Both of the cams 102 and 104 are operative to engage pins 110, 112, 114, 116, 118 and 120 extending from the nip baffles 130, 132, 134, 136, 138, and 140, respectively. A rotatable handle (not shown in FIGS. 2-4 but discussed below) is also connected to the core element. Also shown are the radial extensions 150, 152, 154, 156, 158, and 160 of the cams, as well as the corresponding grooves 170, 172, 174, 176, 178, and 180. The grooves are sized to receive the respective pins of the nip baffles. Of course, it will be appreciated that the form of the cams to accomplish the objectives of the presently described embodiments may vary from application to application.

In one form, the mechanism includes a set of planetary gears, e.g. a ring gear 190, a sun gear 192 and four planet gears 194. By holding the axles of the planetary gears in a fixed position and rotating the sun gear, the ring gear will rotate in the reverse direction and at a slightly slower rate, underdriven. So, in one form, the sun gear is attached to the first cam and the ring gear is attached to the second cam. The progress of the rotation, and subsequent change of positions of the pins of the nip baffles, is illustrated in FIG. 2-4. Of course, it will be appreciated that the implementation of the movement of the cams to accomplish the objectives of the presently described embodiments may vary from application to application.

FIG. 2 illustrates the dual cam retraction mechanism in closed state. FIG. 3 shows the dual cam retraction mechanism mid way in the process of retracting the nip baffles. So, the respective pins have changed positions within the grooves on the radial extensions of the cams. It should be appreciated that, for ease of viewing FIG. 3 and other figures herein, not all reference numerals are shown on each drawing. FIG. 4 shows the dual cam retraction mechanism at end of the retraction process. Cams 102 and 104 are completely clear of pins. Nip baffles are, thus, placed in an open state. In one form, springs are provided so that the nip baffles remain in the open state.

It should be appreciated that, once the pins are released from the cams, further rotation of the cams might cause the radial extensions of the cams to interfere with the next set of pins along the rotation. However, the jam clearing cycle typically implements a 360 degree rotation. So, it advantageous to shift the cams away from the pins once the pins are disengaged from the cams. To do so, the system is provided with a ramp drive mechanism to shift the cam toward the pins during insertion and away from the pins during retraction. In one form, the ramp drive mechanism shifts the cams out of plane and away from nip baffle pins after the baffles have been retracted. So, for example, after approximately 35 degrees (could be more or less) of handle rotation, the nip baffles are completely retracted and the pins have been disengaged from the retractor cams. At this point, the cams shift in order to avoid crashing into the pins during the rest of the 360 degree jam clearing cycle. If the core element were being inserted, it should be understood that the ramp drive mechanism would shift the cams toward to pins to facilitate engagement.

Figure 5:
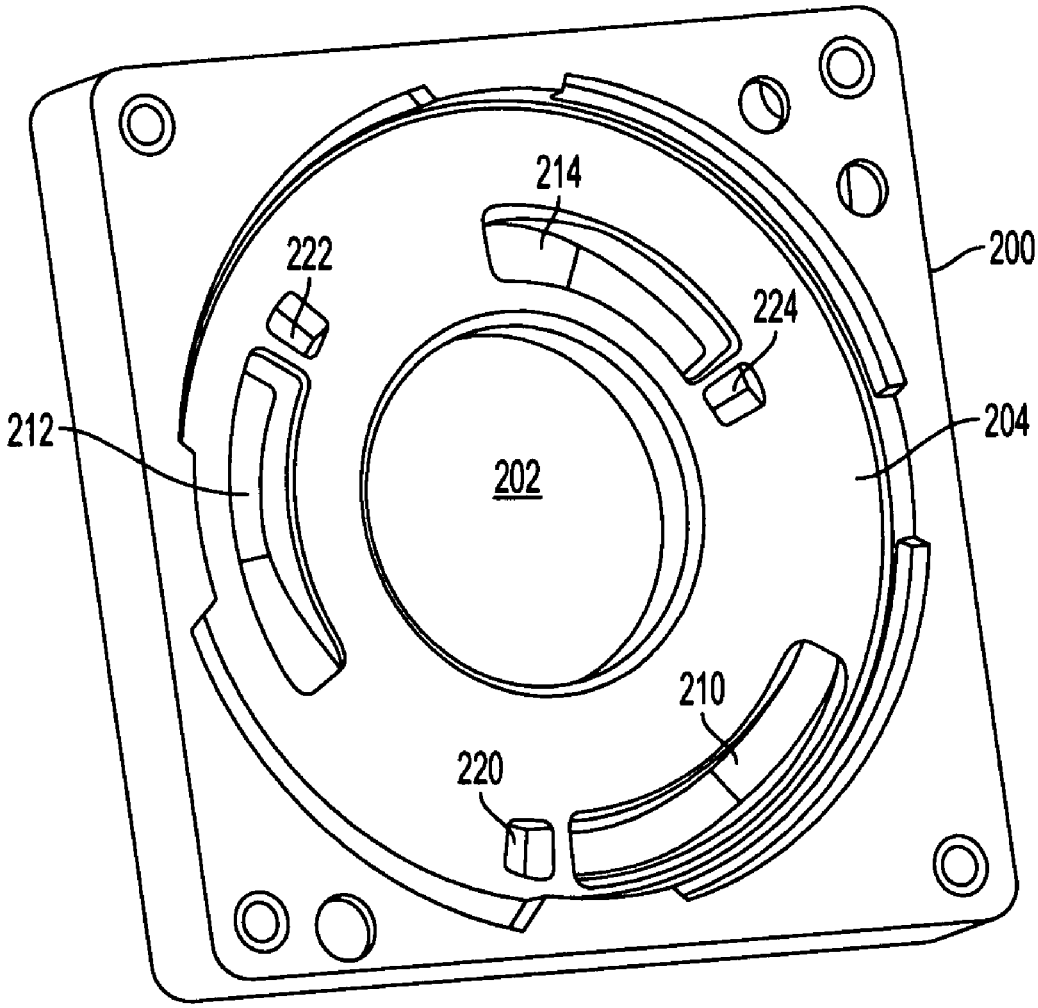
FIG. 5 is a perspective view of a portion of a driving ramp mechanism of the presently described embodiments.
Figure 6:
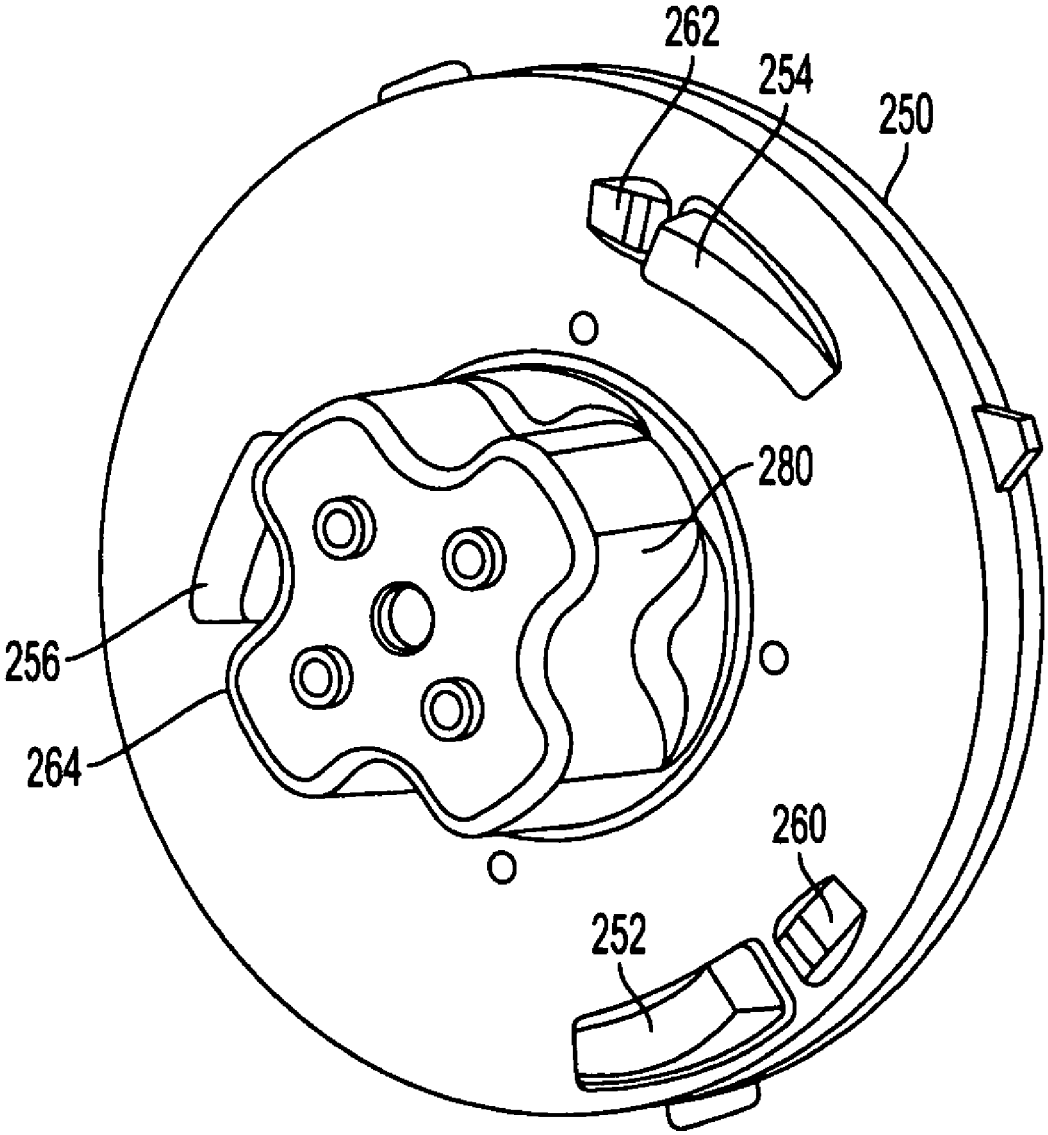
FIG. 6 is a perspective view of a corresponding portion of a driving ramp mechanism of the presently described embodiments.

In one form, the ramp drive mechanism includes a front panel 200 (FIG. 5) and a ramp disk 250 (FIG. 6). When these two parts are mated and the ramp disk 250 is rotated, retraction cams are shifted away from the nip baffle pins by, in one form, 4 to 8 mm. Of course, this distance could vary.

With reference to FIG. 5, the front panel 200 includes an aperture 202 defined by a recessed portion 204. The recessed portion 204 is, as shown, circular in nature. It is provided with various features disposed along circumferential paths there within. For example, ramps 210, 212 and 214 are defined in the recessed portion 204. Also, detents 220, 222 and 224 are positioned at an end of the ramps, respectively. It should be understood that, in one form, the detent and ramp pairs circumferentially disposed in the recessed portion are disposed at different radial distances, or circumferences, from the aperture.

In this regard, a feature of this mechanism is the fact that the ramps share equal swept angles but unequal radii. This layout allows the ramp disk to rotate, travel up the ramps and finish rotation at a final position ~360 degrees. Each ramp is able to pass near the other ramp without falling into the adjacent ramp pocket. Additionally, at both the closed and open position, the detents are engaged, providing a "snap" or "click" action user-cue at both beginning and end of cycle. Furthermore, these detents also act as a locking mechanism to hold the director core in the closed or open position.

With reference to FIG. 6, the ramp disk 250 is shown. The disk 250 includes ramp protrusions 252, 254, and 256 which correspond to ramps 210, 212, and 214 when the front panel and disk are mated. Likewise, detent protrusions 260, 262, and 264 correspond to detents 220, 222, and 224. Also shown is a connector mechanism 280 operative to connect the disk to the core element. A handle is also provided to the disk, but not shown here.

The handle is operative to facilitate insertion of the core element into the module and retraction of the core element from the module. The handle is operative to rotate the first and second cam to change an orientation of engaged nip baffles through movement of the pins.

Figure 7:
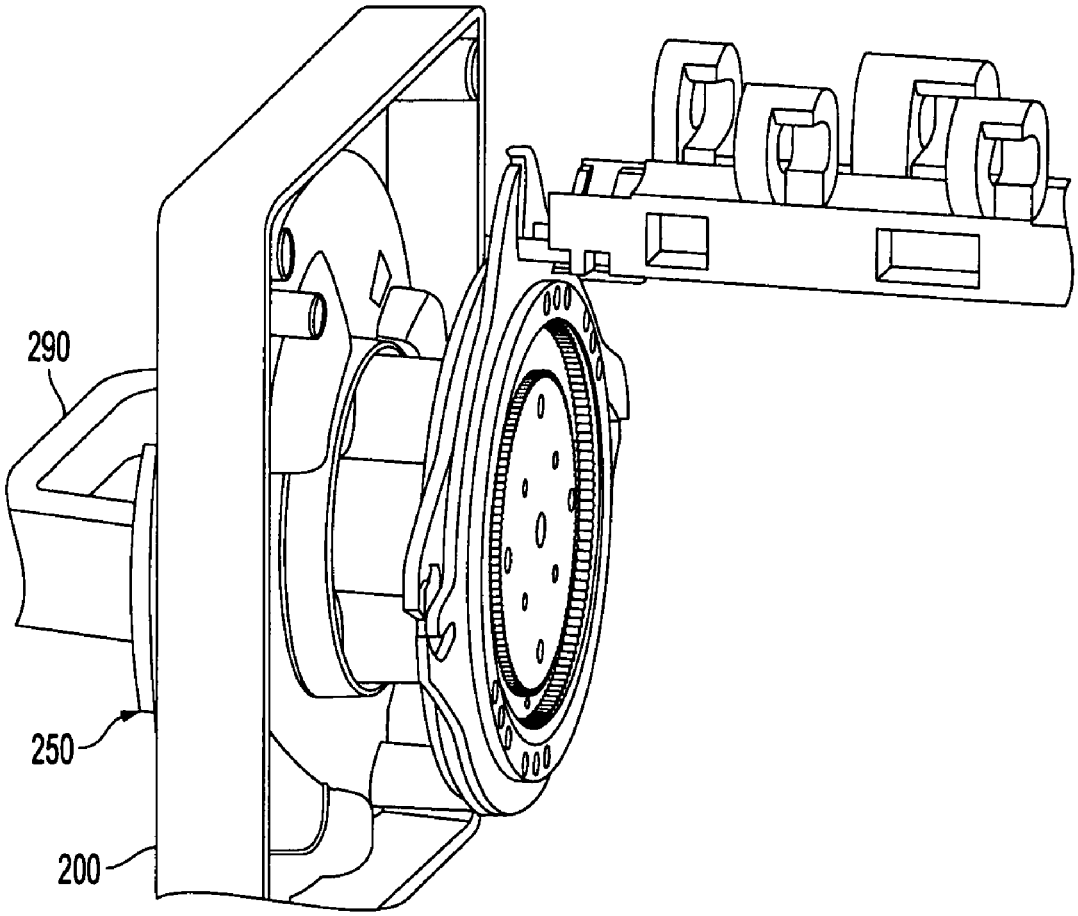
FIG. 7 is a perspective view of one embodiment of the presently described embodiments.
Figure 8:
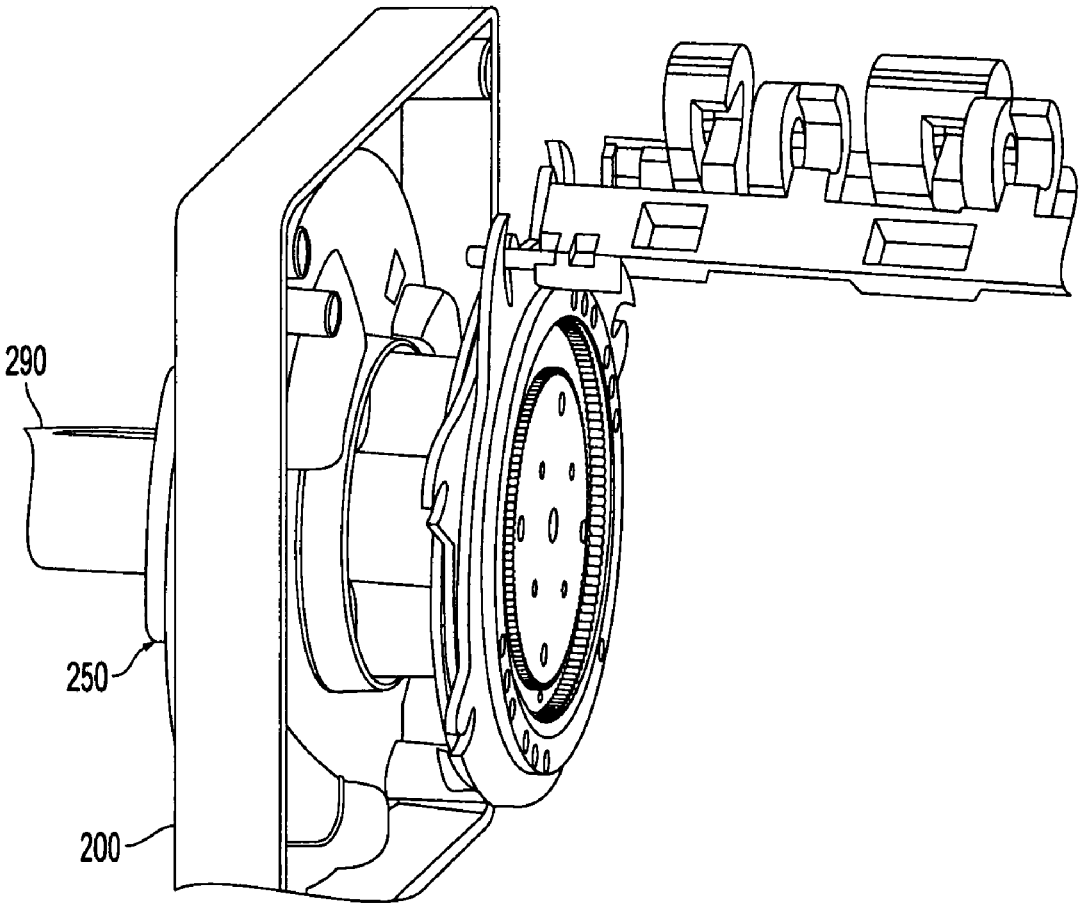
FIG. 8 is a perspective view of one embodiment of the presently described embodiments.
Figure 9:
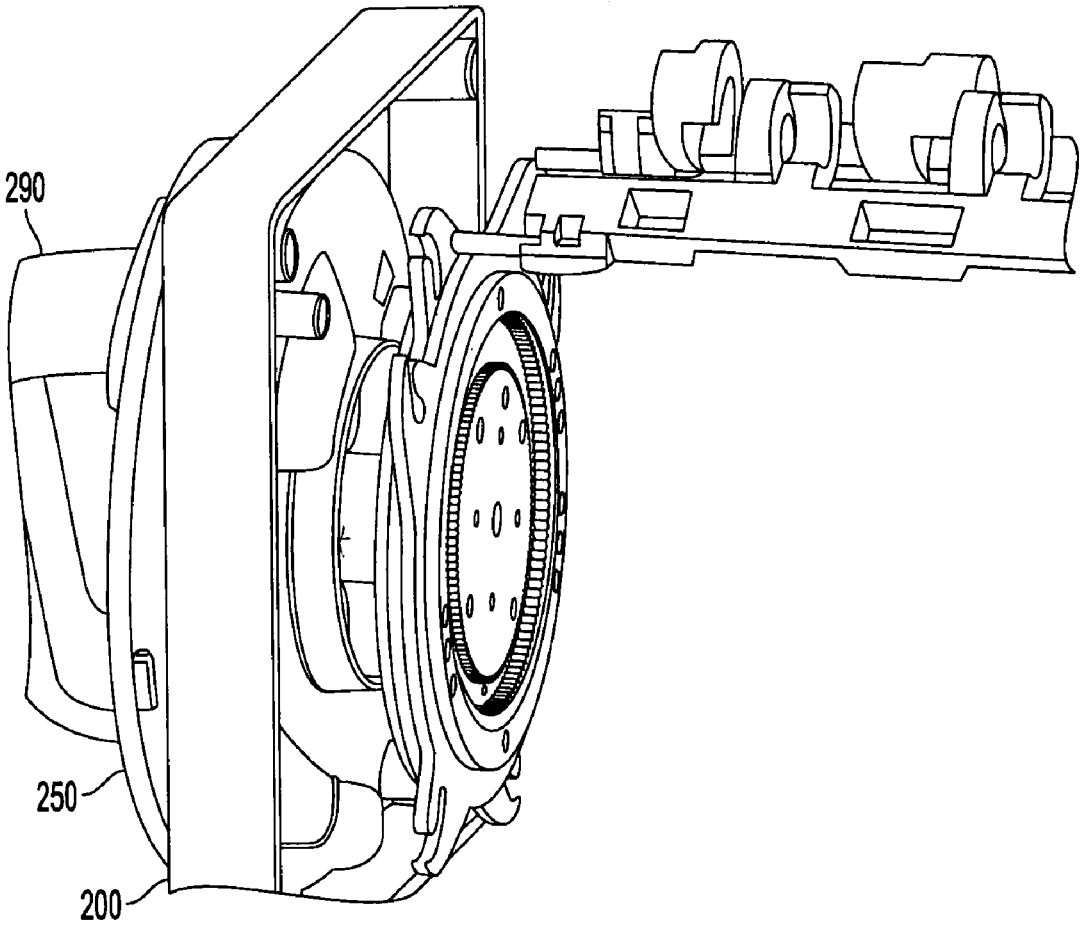
FIG. 9 is a perspective view of one embodiment the presently described embodiments.

FIGS. 7-9 show a dual cam retractor opening one set of nip baffles. The same applies for the single cam retractor (which will be described in connection with FIGS. 10-12). FIG. 7 illustrates the closed state. This corresponds to FIG. 2, but also shows the ramp mechanism, e.g. handle 290, disk 250 and front panel 200. FIG. 8 shows the assembly midway retracted. Notice that the pins and corresponding nip baffles have changed position when compared to FIG. 7. FIG. 9 shows a fully retracted state with cams shifted forward away from pins. Notice how the handle assembly and cams have moved to the left.

Figure 10:
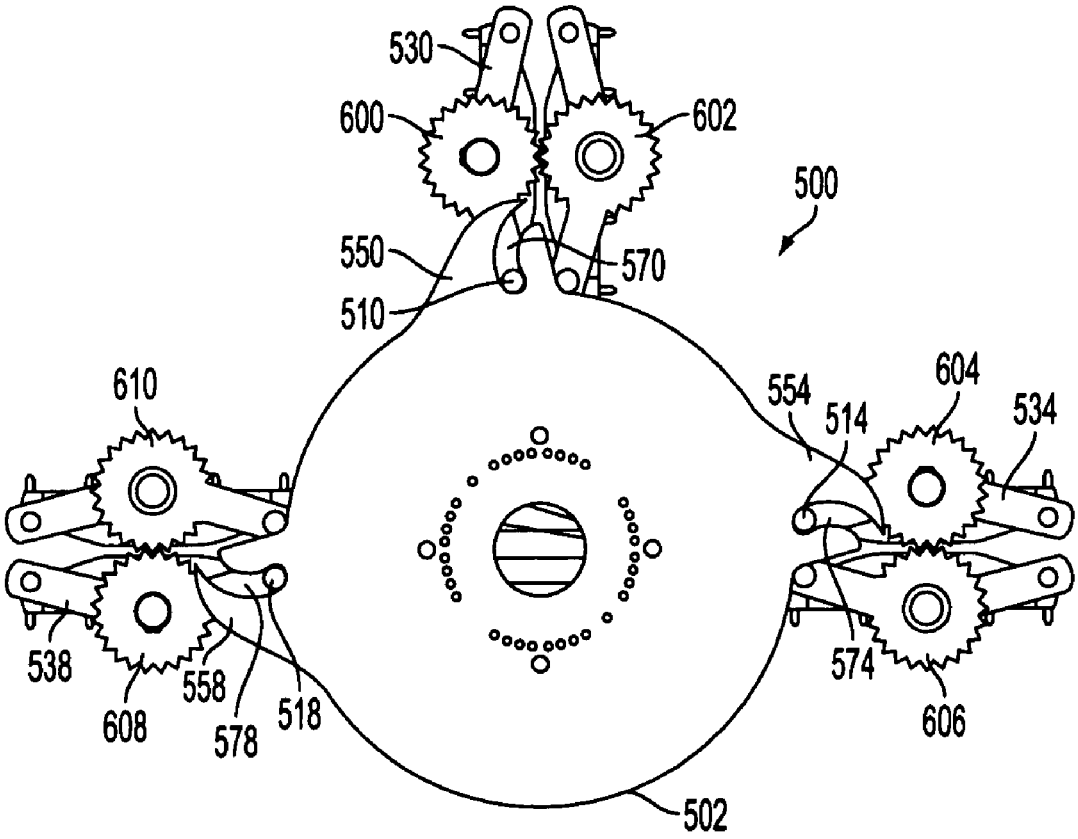
FIG. 10 is a side view of a single cam arrangement of the presently described embodiments.
Figure 11:
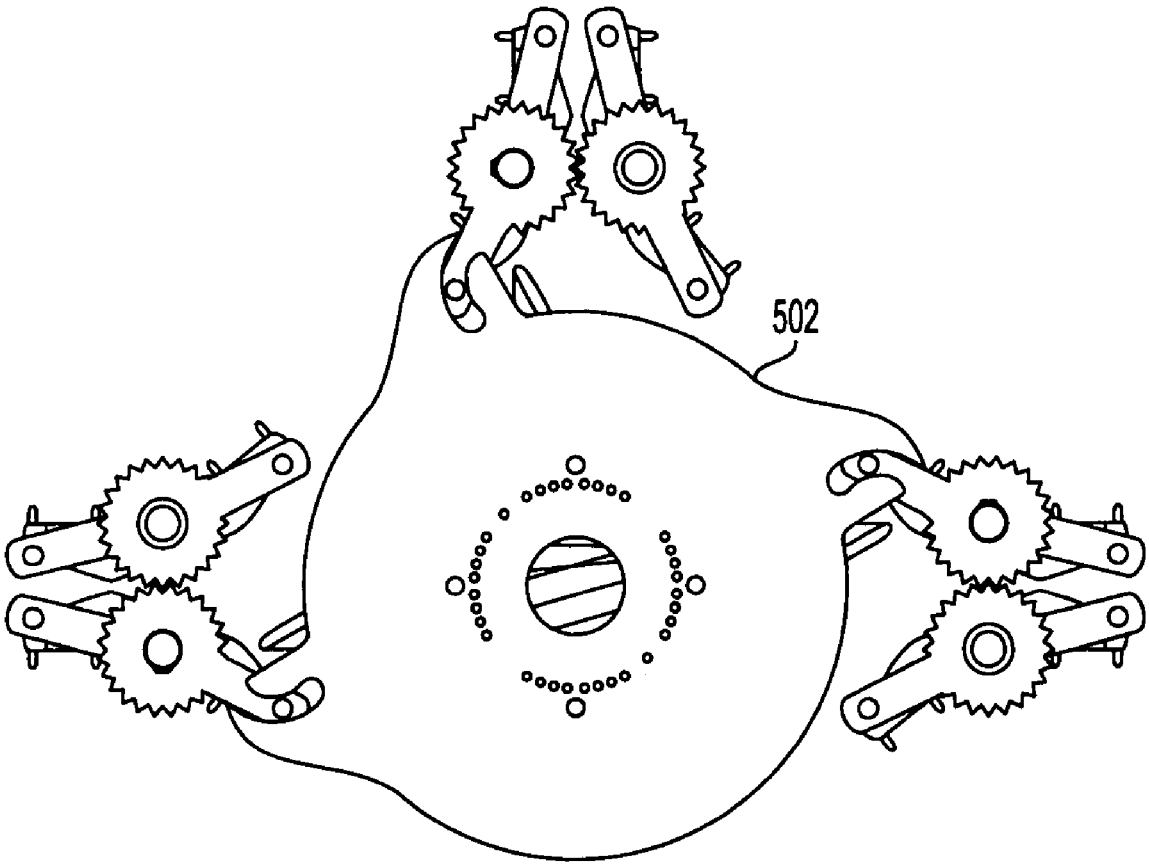
FIG. 11 is a side view of a single cam arrangement of the presently described embodiments; and, FIG. 12 is a side view of a single cam arrangement of the presently described embodiments.
Figure 12:
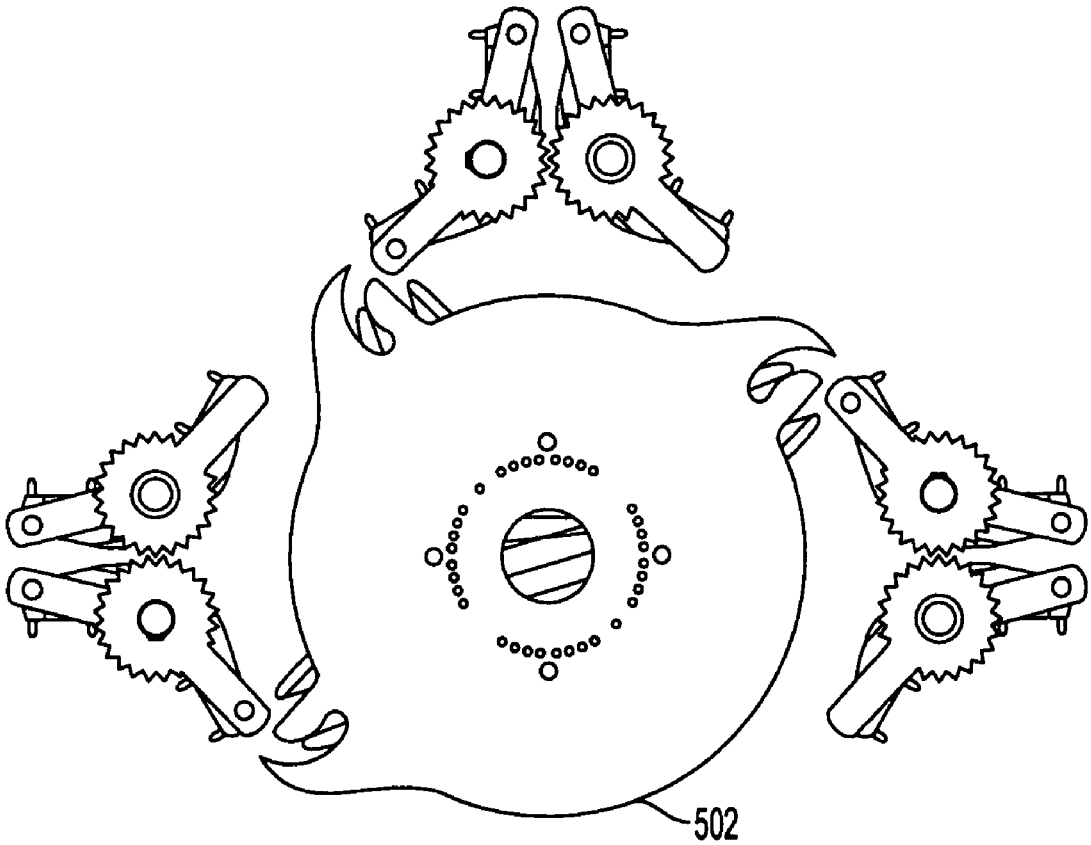

As alluded to above, a single cam retractor may also be implemented according to the presently described embodiments. In one form, a single cam retractor has many fewer parts and may be less expensive to manufacture. FIG. 10-12 illustrate one embodiment of a single cam retractor according to the presently described embodiments.

With reference to FIG. 10, a mechanism 500 includes a cam 502 connected to the core element (not shown). The cam 502 is operative to engage pins 510, 514, and 518 extending from the nip baffles 530, 534, and 538, respectively. A rotatable handle and other components that allow for operation of the system as contemplated herein (not shown in FIGS. 10-12 but discussed above in connection with FIGS. 7-9) are also connected to the core element. Also shown are the radial extensions 550, 554, and 558 of the cams, as well as the corresponding grooves 570, 574, and 578. The grooves are sized to receive the respective pins of the nip baffles. Of course, it will be appreciated that the form of the cams to accomplish the objectives of the presently described embodiments may vary from application to application.

Also shown in FIG. 10 are gears 600, 602, 604, 606, 608 and 610. In this regard, a set of 1:1 spur gears have been added to nip baffles so that driving one pin with one cam will close both baffles simultaneously. This is one exemplary manner of accomplishing this task, but it will be understood that a variety of approaches may be adopted. The added gears and tangs can be integrated with the nip baffle parts and created in the same injection molding operation, thus, reducing the part count and manufacturing costs.

FIG. 10 illustrates the assembly of the single cam retraction mechanism in closed state. FIG. 11 shows the single cam retraction mechanism mid way through the process of retracting the nip baffles. Last, FIG. 12 shows the single cam retraction mechanism at end of process. The cam 502 is completely disengaged from the pins. In one form, the nip baffles are sprung to remain in a normally open state.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An apparatus for clearing paper jams in a module along a print path of a printer, the module having nip baffles and a rotatable and removable core element defining a print path therethrough, the apparatus comprising:

at least one cam connected to the core element operative to engage pins extending from the nip baffles;

a rotatable handle connected to the core element to facilitate insertion of the core element into the module and retraction of the core element from the module, the handle being operative to rotate the cam to change an orientation of engaged nip baffles through movement of the pins; and, a ramp drive mechanism associated with the handle operative to shift the cam toward the pins during insertion and away from the pins during retraction.

2. The apparatus as set forth in claim 1 wherein the at least one cam comprises radial extensions having grooves therein sized to receive the pins.

3. The apparatus as set forth in claim 1 wherein the at least one cam comprises two cams.

4. The apparatus as set forth in claim 1 wherein the at least one cam is one cam.

5. The apparatus as set forth in claim 4 further comprising a second set of pins associated with a second set of nip baffles operatively connected to the nip baffles through a gear mechanism.

6. The apparatus as set forth in claim 1 wherein the ramp drive mechanism comprises a configuration of detents and ramps.

7. An apparatus for clearing paper jams in a module along a print path of a printer, the module having nip baffles and a rotatable and removable core element defining a print path therethrough, the apparatus comprising:

a first cam connected to the core element operative to engage a first set of pins extending from a first set of the nip baffles;

a second cam connected to the core element operative to engage a second set of pins extending from a second set of the nip baffles;

a rotatable handle connected to the core element to facilitate insertion of the core element into the module and retraction of the core element from the module, the handle being operative to rotate the first and second cams to change an orientation of engaged nip baffles of the first set of nip baffles and of the second set of nip baffles through respective movement of the first set pins and the second set of pins; and, a ramp drive mechanism associated with the handle operative to shift the first cam and the second cam toward the first and second set of pins during insertion and away from the first and second set of pins during retraction.

8. The apparatus as set forth in claim 7 wherein the first and second cam each comprise radial extensions having grooves therein sized to receive pins.

9. The apparatus as set forth in claim 7 wherein the ramp drive mechanism comprises a configuration of detents and ramps.

10. An apparatus for clearing paper jams in a module along a print path of a printer, the module having nip baffles and a rotatable and removable core element defining a print path therethrough, the apparatus comprising:

at least one cam connected to the core element operative to engage a set of pins extending from a first set of the nip baffles;

a set of gears operatively connecting the first set of the nip baffles with a second set of the nip baffles;

a rotatable handle connected to the core element to facilitate insertion of the core element into the module and retraction of the core element from the module, the handle being operative to rotate the cam to change an orientation of engaged nip baffles through movement of the set of pins; and, a ramp drive mechanism associated with the handle operative to shift the cam toward the pins during insertion and away from the pins during retraction.

11. The apparatus as set forth in claim 10 wherein the at least one cam comprises radial extensions having grooves therein sized to receive the pins.

12. The apparatus as set forth in claim 10 wherein the ramp drive mechanism comprises a configuration of detents and ramps.

13. An apparatus for clearing paper jams in a module along a print path of a printer, the module having nip baffles defining a print path therethrough, the apparatus comprising:

cam means for engaging pins extending from the nip baffles;

handle means for rotating the cam means to change an orientation of engaged nip baffles through movement of the pins; and, ramp means for shifting the cam means toward the pins during insertion and away from the pins during retraction.

14. The apparatus as set forth in claim 13 wherein the cam means comprises radial extensions having grooves therein sized to receive the pins.

15. The apparatus as set forth in claim 13 wherein the cam means comprises two cams.

16. The apparatus as set forth in claim 13 wherein the cam means is one cam.

17. The apparatus as set forth in claim 16 further comprising a second set of pins associated with a second set of nip baffles operatively connected to the nip baffles through a gear mechanism.

18. The apparatus as set forth in claim 3 wherein the ramp means comprises a configuration of detents and ramps.

19. A method for clearing paper jams in a module along a print path of a printer, the module having nip baffles defining a print path therethrough, the method comprising:

engaging pins extending from the nip baffles by a cam;

rotating the cam to change an orientation of engaged nip baffles through movement of the pins; and, shifting the cam toward the pins during insertion and away from the pins during retraction.

* * * * *